US006474696B1

(12) United States Patent
Canale

(10) Patent No.: US 6,474,696 B1
(45) Date of Patent: Nov. 5, 2002

(54) TELESCOPIC EXTENSION FOR A HOUSEHOLD APPLIANCE AND METHOD FOR ASSEMBLING THEREOF

(75) Inventor: Giuseppe Canale, Gorla Minore (IT)

(73) Assignee: Omec S.p.A., Gorla Minore (IT)

( * ) Notice: Subject to any disclaimer, the term of this patent is extended or adjusted under 35 U.S.C. 154(b) by 0 days.

(21) Appl. No.: 09/445,416

(22) PCT Filed: Jun. 4, 1998

(86) PCT No.: PCT/EP98/03494

§ 371 (c)(1),
(2), (4) Date: Dec. 8, 1999

(87) PCT Pub. No.: WO98/56289

PCT Pub. Date: Dec. 17, 1998

(30) Foreign Application Priority Data

Jun. 10, 1997 (IT) ..... MI97A1364

(51) Int. Cl.[7] ..... A47L 9/24
(52) U.S. Cl. ..... 285/7; 285/316; 285/320
(58) Field of Search ..... 285/37, 303, 310, 285/316, 317, 320, 330

(56) References Cited

U.S. PATENT DOCUMENTS 3,244,437 A * 4/1966 Belicka et al. ..... 285/7
3,351,359 A * 11/1967 Ferraris ..... 285/7
3,351,363 A * 11/1967 Downey et al. ..... 285/330
3,446,523 A * 5/1969 Little ..... 285/303
3,454,047 A * 7/1969 Johnston ..... 285/316
5,046,761 A * 9/1991 Cordes ..... 285/7
5,332,266 A * 7/1994 Canale ..... 285/7
5,685,044 A * 11/1997 Lavis et al. ..... 285/330

FOREIGN PATENT DOCUMENTS

EP 0 601 620 B1 6/1994

* cited by examiner

*Primary Examiner*—Frank Vanaman
(74) *Attorney, Agent, or Firm*—Nixon & Vanderhye, P.C.

(57) ABSTRACT

A telescopic extension (1; 41) for a household appliance comprises an inner tube (2) tightly sliding in an outer tube (3), a sleeve (4; 44), a constraining element (5) between the inner tube (2) and the outer tube (3), a thrust element (6), and an actuator (7). In the extension (1; 41), a tubular end portion (9; 49) associated with the outer tube (3) has a relief (11) forming a niche (12). The sleeve (4; 44) is provided with a projection (15) which is inserted in the niche (12). The sleeve has a hollow (18) wherein the constraining element (5), thrust element (6), and a spring (21) are completely housed. The thrust element (6) is formed by a lengthened, flattened slider (28) provided with a narrow portion (20) having recesses. The actuator (7) has protruding wings (37) provided with inner small teeth (38) which are snap-on coupled with the recesses. (FIG. 1)

14 Claims, 5 Drawing Sheets

TELESCOPIC EXTENSION FOR A HOUSEHOLD APPLIANCE AND METHOD FOR ASSEMBLING THEREOF

BACKGROUND

1. Field of the Invention

This invention relates to a telescopic extension for a household appliance and a method for assembling thereof.

2. Related Art and Other Considerations

EP-B1-0 520 534 describes a telescopic extension for a vacuum cleaner, comprising an inner tube and an outer tube, sliding tightly one within the other, a sleeve, a constraining means between the inner and outer tube, a thrust slider and an actuating pushbutton.

The inner tube is provided with a row of notches of a preselected shape and the outer tube has a tubular end portion of a flared shape, which is integral with the outer tube and carries a sleeve fastened to its interior.

The constraining means consists of a small cylinder integral with a small plate provided with a pin. By means of the pin and the small plate, the small cylinder is rotatably supported in a hollow of the sleeve. The sleeve has an opening through which the small cylinder can engage a notch of the inner tube and disengage from the same.

In this telescopic extension, the thrust slider is integral and is formed as a single piece with the actuating pushbutton.

The thrust slider is slidingly supported inside the hollow of the sleeve and is subjected to the action of spring means.

The spring means operate the thrust slider to engage the small plate integral with the small cylinder and pin, so as to force the latter into the notch of the inner tube and to lock the inner tube in the outer tube. The extension thus assumes a preselected length.

For adjusting the extension's length, the actuating pushbutton is manually pushed against the action of the spring means, so as to allow the thrust slider to disengage from the small plate and to let the small cylinder exit from the notch of the inner tube, thus unlocking the inner tube from the outer tube. By sliding the inner tube in the outer tube, the extension assumes the desired length.

For assembling the extension, the sleeve is fitted over the internal tube and the pushbutton-slider assembly is premounted in the hollow of the sleeve, together with the spring means and the constraining means. The sleeve is then inserted in the tubular end portion, centered with respect to it, and the inner tube is mounted inside the outer tube. For allowing the pushbutton protruding from the slider to pass through, the tubular end portion of the outer tube must have an opening extending up to the outer rim and forms an inlet mouth for the slider-pushbutton assembly.

An opening of this shape and width has the disadvantage of weakening the outer tube and thus reducing its resistance to the working stresses.

Moreover, the need to hold the slider, the spring means and the constraining means firmly inside the hollow of the sleeve, before and while inserting the sleeve in the tubular end portion, make the assembling difficult and expensive.

EP-B1-0 601 620 describes a telescopic extension for a vacuum cleaner which comprises, as for the extension of EP-B1-0 520 534, an inner and an outer tube sliding tightly within each other, a sleeve, a constraining means between the outer and inner tube, a thrust slider and an actuating pushbutton.

In this second extension, the thrust slider is always integral and is formed as a single piece with the actuating pushbutton, while the sleeve is fastened to the outer tube. A tubular end portion, which is separate from the outer tube and has an internal diameter wider than the outer diameter of the outer tube, is fitted over the sleeve. The constraining means and the thrust slider are movably supported in a hollow of the sleeve.

The separate tubular portion has an opening extending up to the external rim and forms an inlet mouth for the slider-pushbutton assembly so as to allow the pushbutton protruding from the thrust slider to pass through. The outer tube also has an opening of the same shape, which allows the constraining means to engage a notch of the inner tube, and has a width capable of housing a projection of the sleeve, which allows it to be centered with respect to the outer tube.

This second extension is rather stronger than the first one, but its assembling is still quite difficult and expensive for the reasons already mentioned.

DE-A-42 00 526 discloses a telescopic extension for a vacuum cleaner comprising an inner tube, an outer tube, a sleeve arranged between them, a constraining small cylinder, a thrust element and an actuating knob.

The thrust element is formed by a flattened curved plastic piece comprising a quadratic body provided with a rectangular notch and a T-shaped projection. A groove for housing a torsion spring is arranged between said body and said projection.

The outer tube is provided with an opening having two narrow portions and two enlarged portions.

In turn, the actuating knob has four connecting small feet which are provided with undercuts directed towards the outside thus forming outer small teeth.

For assembling said extension, said constraining small cylinder, thrust element and spring are housed in said sleeve that is inserted in a flared portion of the outer tube. Then, when fastening the actuating knob to the thrust element, said thrust element is pressed against the action of the spring in direction of the arrow R of FIG. 5 in order to ring said thrust element under said opening of said outer tube in a position (outside the operating stroke) such that the respective T-shaped projection is located under the first enlarged portion of said opening and the respective notch is located under the second enlarged portion of said opening.

In said position, the two front connecting small feet of said actuating knob engage the T-shaped projection of said thrust element and the two near connecting small feet penetrate inside the notch of said thrust element.

Afterwards, upon releasing said thrust element, the spring pushes the actuating knob in the direction of the arrow L of FIG. 5 and brings the undercuts of the four small feet under the edges of the narrow portions of the opening of said outer tube. The actuating knob is so fastened to both the thrust element and the outer tube.

Said assembling method is very complex, time consuming and expensive.

Moreover, in the extension of DE-A-42 00 526, every time the actuating knob is driven to perform forward and rearward strokes for adjusting the length of the extension, the undercuts of the small feet slide with attrition along the edges of the narrow portions of the opening of said outer tube. Thus, said small feet undergo a quick earing whih causes clearance and even notching. This is a quick failure of said actuating knob.

SUMMARY

A first object of this invention is a telescopic extension for a household appliance, preferably a vacuum cleaner, stronger and more efficient than those described in the foregoing documents.

A second and even more important object of the invention is to allow the structure of this telescopic extension to be manufactured and assembled in a simpler and more economical manner than that required by known extensions.

According to a first aspect, this invention relates to a telescopic extension for a household appliance comprising an inner tube and an outer tube (sliding tightly within each other), a sleeve, a constraining means capable of fastening the inner and outer tube, a thrust element in engagement with the constraining means under the action of spring means, and actuating means operatively connected to the thrust element. The inner tube is provided with a row of notches of preselected shape and a tubular end portion provided with a slot being associated with the outer tube. The sleeve is fastened to the tubular end portion. The constraining means, thrust element, and spring means are movably supported in the sleeve. The thrust element acts on the constraining means, under the action of the spring means, to force the constraining means into one notch to lock the inner tube in the outer tube. The actuating means is capable of disengaging the thrust element from the constraining means to let the constraining means exit from the notch and unlock the inner tube from the outer tube, thereby allowing the inner tube to slide in respect of the outer tube for adjusting the length of the extension. The actuating means is a separate piece from the thrust element and has protruding wings capable of penetrating the slot. The tubular end portion has a relief forming a niche. The sleeve is provided with a projection which is inserted in the niche and has a hollow wherein the constraining means, thrust element, and spring means are completely housed. The thrust element, in turn, is formed by a lengthened, flattened slider provided with a narrow portion having recesses. The protruding wings of the actuating means are provided with inner small teeth capable of being snap-on coupled with the recesses.

According to a second aspect, there is provided a method for assembling a telescopic extension for a household appliance, the appliance comprising an inner tube, an outer tube, a sleeve, a constraining means capable of fastening the inner tube and outer tube, a thrust element, actuating means, and spring means. The inner tube is provided with a row of notches having a preselected shape and a tubular end portion provided with a slot being associated with the outer tube. The actuating means is a separate piece from the thrust element and has protruding wings capable of penetrating the slot. The method comprises the following steps:

a) fitting the sleeve over one of the inner tube and outer tubes,
b) movably placing the constraining means, thrust element, and spring means in the sleeve,
c) inserting the inner tube in the outer tube so as to tightly slide one within the other and inserting the sleeve in the tubular end portion, and
d) inserting the wings of the actuating means in the slot of the tubular end portion, characterised in that
e) in step b), the constraining means, thrust element, and spring means are completely housed into a hollow of a projection of the sleeve,
f) in step c), the sleeve is centered in respect of the outer tube by means of the projection which fits a niche of a relief of the tubular end portion, and
g) in step d), inner small teeth of the wings are snap on coupled to recesses of a lengthened, flattened slider which forms the thrust element so that the actuating means are fastened to the thrust element.

The telescopic extension of this invention has the advantage of being very compact and capable of withstanding the working stresses.

The method of assembling according to this invention considerably simplifies the assembling steps and eliminates mounting difficulties and errors, because the thrust element and the spring means are completely housed in the hollow of the sleeve and remain properly positioned therein when the sleeve is inserted inside the tubular end portion. Thereafter, the actuating means are fastened to the thrust element by causing their coupling elements to penetrate the slot in the tubular end portion.

Thus, the method of this invention substantially reduces the assembling time and costs, and, moreover, it can be easily automatized.

BRIEF DESCRIPTION OF THE DRAWINGS

Features and advantages of the invention shall now be described with reference to embodiments shown as a non limiting example in the enclosed drawings, where.

DETAILED DESCRIPTION

Figure 1:
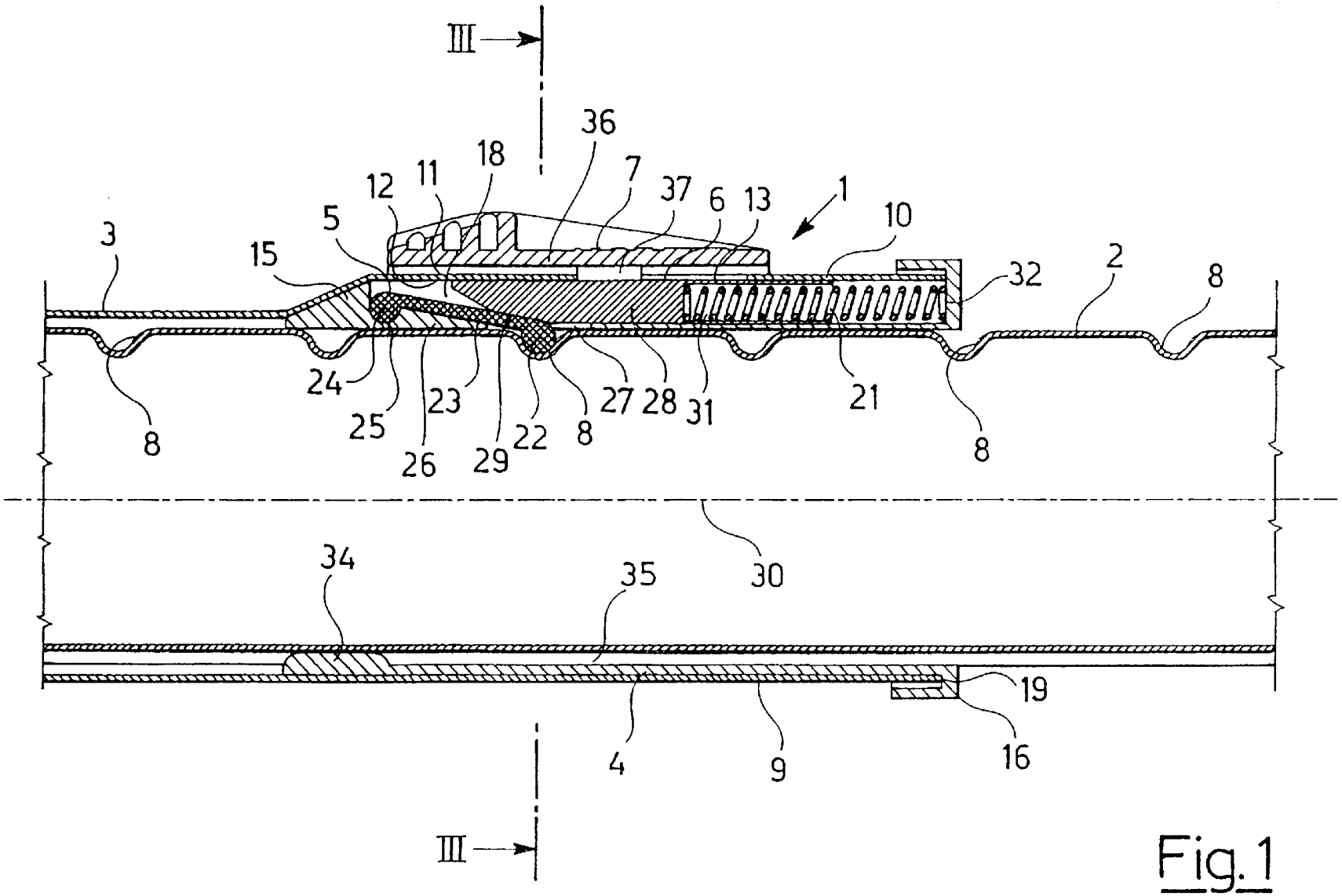
FIG. 1 is a longitudinal cross-sectional view of a telescopic extension for a household appliance, embodied according to the invention.
Figure 2:
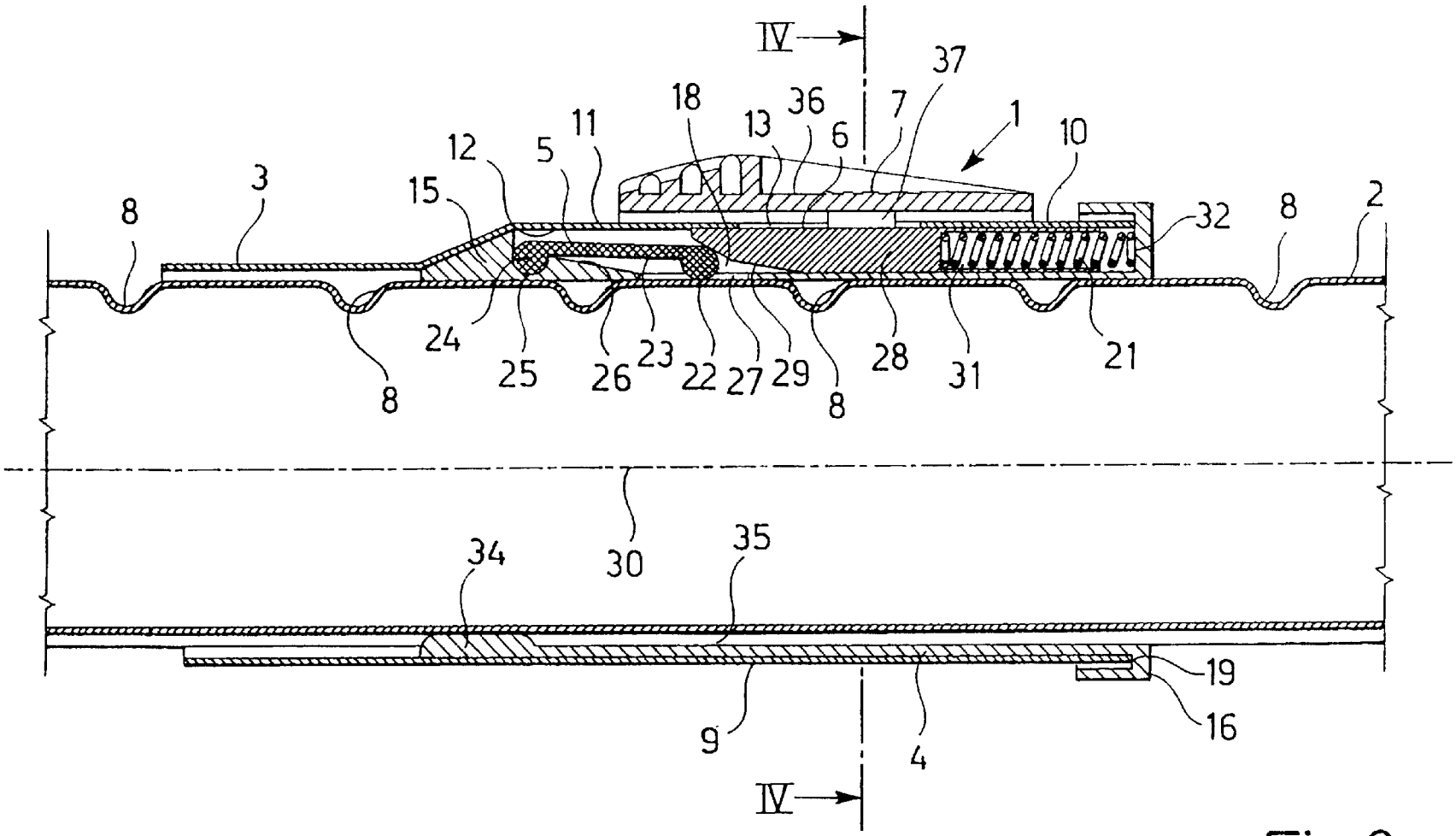
FIG. 2 shows the extension of FIG. 1 in a different operating condition.

FIGS. 1 and 2 show a telescopic extension for a household appliance, such as a vacuum cleaner, indicated as a whole by the reference numeral 1. The extension 1 comprises an inner tube 2 and outer tube 3 (sliding tightly one within the other), a sleeve 4, a constraining means 5, a thrust element 6, and actuating means 7.

The inner tube 2 has a row of notches 8 of a partially cylindrical shape. The inner tube 2 is provided with a usual sealing gasket (not shown) which allows the inner tube 2 to slide tightly within the outer tube 3.

Figure 4:
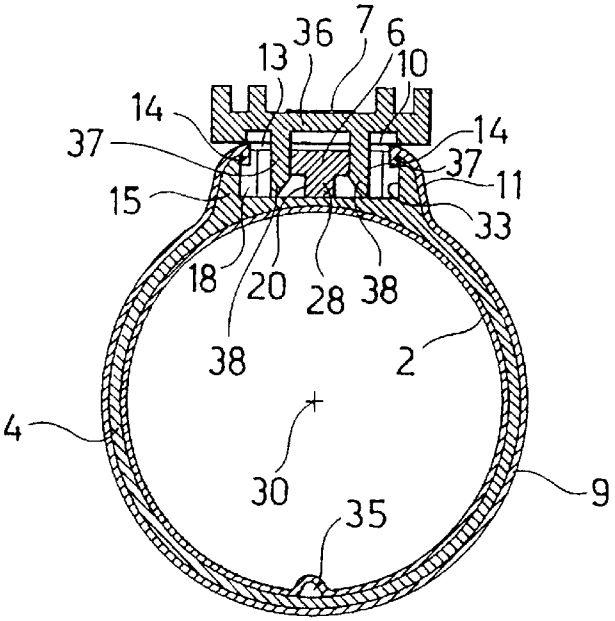
FIG. 4 is a cross-sectional view according to the plane indicated with IV—IV in FIG. 2.

The outer tube 3 has a tubular end portion 9 integral thereto that is formed as a single piece having the same inner and outer diameter as the outer tube 3. The tubular end portion 9 is provided with a relief 11 of a substantially parallelepiped shape, projecting toward the outside, which encloses a niche 12. The upper wall 10 of the relief 11 has a slot 13 provided with protruding fins 14 (FIG. 4).

The sleeve 4 has a projection 15 having a substantially parallelepiped shape that fits the niche 12 for centering purpose. The projection 15 has a hollow or cavity 18 in which the constraining means 5, thrust slider 6, and a spring 21 are housed.

For example, the tubes 2 and 3 are made of chromium-plated stainless steel sheet and the sleeve 4 is made of a suitable plastic material.

Figure 7:
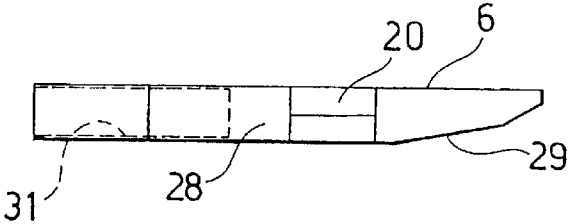
FIGS. 6 and 7 are enlarged bottom and side views, respectively, of a thrust slider of the telescopic extension of FIG. 1.
Figure 3:
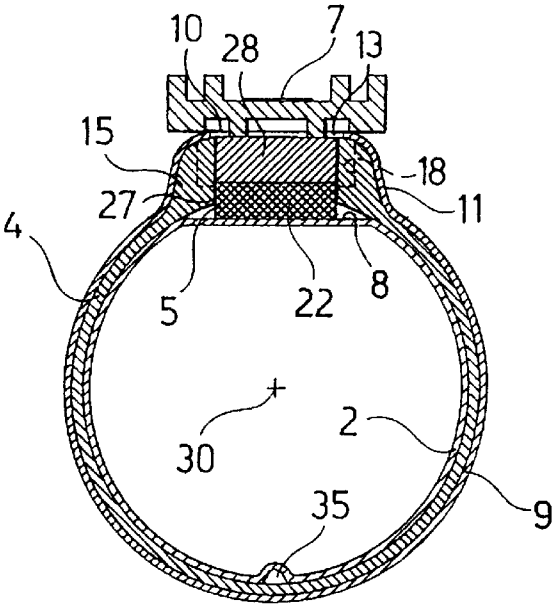
FIG. 3 is a cross-sectional view according to the plane indicated with III—III in FIG. 1.
Figure 6:
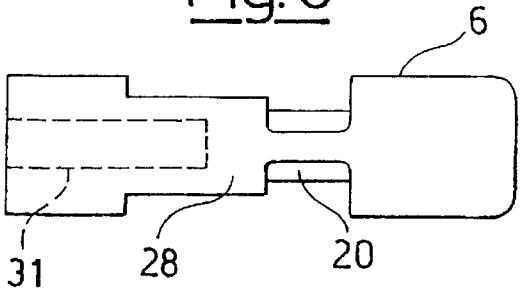

The constraining means 5 is formed by a small cylinder 22 integral with a small plate 23 provided with a pin 24, made (for example) of steel. The hollow 18 is provided with a semi-cylindrical groove 25 housing the pin 24. The hollow 18 also has an inclined ramp 26 on which the small plate 23 rests. The hollow 18 is provided with an opening 27 which allows the small cylinder 22 to move in a substantially radial direction to engage a notch 8 of the inner tube 2 and to disengage the cylinder 22 from the notch 8. The thrust element 6 is formed by a slider 28 with an inclined wall 29 capable of remaining in contact with the small plate 23 (FIGS. 6 and 7). The wall 29 and the ramp 26 have substantially the same inclination angle (about 50) with respect to the longitudinal axis 30 of the tubes 2 and 3. The slider 28 has a narrow portion 20 provided with recesses whose function will be explained hereinafter. The slider 28 is provided with a blind hole 31 partially housing a spring 21. The spring 21 reacts on a wall 32 of the hollow 18 and is mounted precharged so that the inclined wall 29 of the slider 28 is normally kept in contact with the small plate 23 (FIG. 1) In this manner, the small cylinder 22 goes out of the opening 27 and is forced inside notch 8 of the inner tube 2 (FIGS. 1 and 3). The tubes 2 and 3 are thus firmly connected and form an extension 1 of the desired length.

The sleeve 4 is inserted in the tubular end portion 9 so that it is centered by the projection 15 penetrating the niche 12 and is positioned in longitudinal direction by a bent rim 16 which abuts against an outer rim 19 of the tubular end portion 9. The sleeve 4 is fastened to the tubular end portion 9 by means of fins 14 which are bent back against walls 33 of the hollow 18 (FIG. 4) and by means of indentations in the tubular end portion (not shown).

The sleeve 4 is provided with a protrusion 34 which enters a longitudinal groove 35 of the inner tube 2 and guides the inner tube 2 with respect to the outer tube 3 when one slides inside the other for adjusting the length of the extension.

Figure 9:
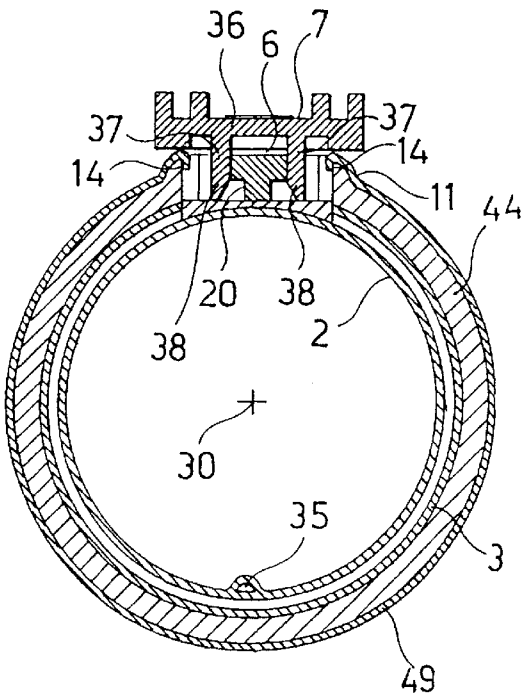
FIG. 9 is a cross-sectional view according to the plane indicated with IX—IX in FIG. 8.

The actuating means 7 are formed by of a pushbutton 36 having partially elastic wings 37, protruding downward and provided with inner small teeth 38 (see FIG. 4 and FIG. 9). The wings 37 penetrate through the slot 13 and are fastened to the slider 28 by means of the inner teeth 38, which are snap-on fastened to the recesses of the narrow portion 20 (FIG. 4).

Figure 5:
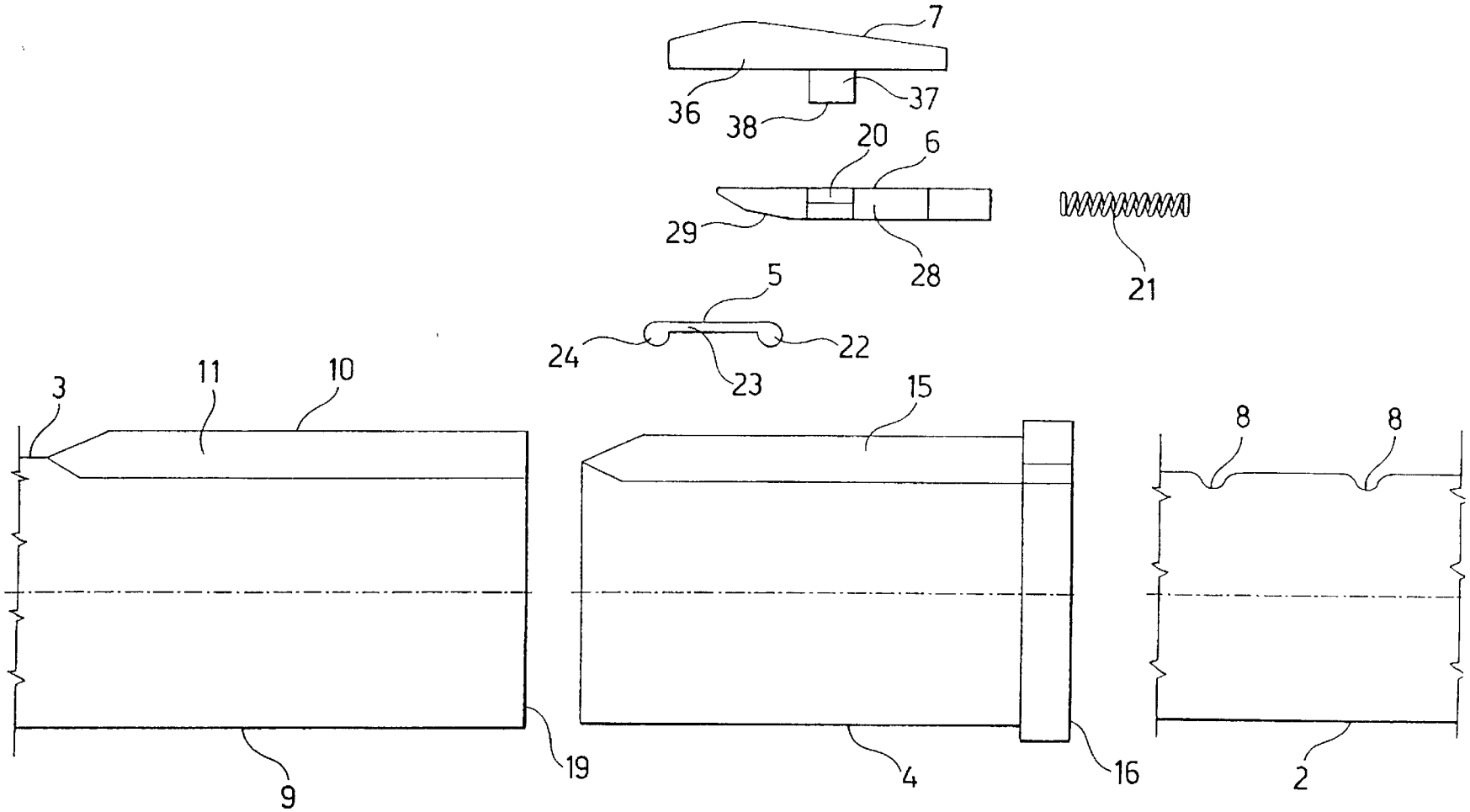
FIG. 5 shows disassembled the extension of FIG. 1.

As shown in FIG. 5, the slider 28 is a piece separate from the pushbutton 36 and has a lengthened and flattened shape which allows it to completely enter the hollow 18 of the sleeve 4, together with the spring 21, thus facilitating introduction of the sleeve 4 inside the tubular end portion 9. After mounting, the slider 28 and the spring 21 lie completely inside the wall 10 which acts as a housing for the thrust slider 28. (FIGS. 1 and 2).

A further advantage of the slider 28 is that the contact between its inclined wall 29 and the small plate 23 is extended over a surface. In fact, the possible wear of the wall 29 will be uniformly distributed over its entire surface, and the presence of the spring 21 avoids the occurrence of clearance between the slider and the small plate.

When adjusting the length of the extension 1, the pushbutton 36 is actuated by hand, by moving it from the position of FIG. 1 to that of FIG. 2, so that the wall 29 moves away from the small plate 23 and lets the small cylinder 22 rise and exit from the notch 8 of the tube 2 in which it was engaged.

This allows the tube 2 to slide within the tube 3, until reaching the desired length of the extension 1.

The assembling of the telescopic extension 1 comprises mounting the sleeve 4 over the inner tube 2, wherein it is guided by means of the protrusion 34 and the longitudinal groove 35, and then placing the small cylinder 22 into the sleeve 4. The small plate 23 rests on the ramp 26 and the pin 24 is housed into the cavity 25 so that the small cylinder 22 is positioned opposite the opening 27. The slider 28 and the spring 21 are then mounted in the hollow 18 of the sleeve 4. The slider 28 and the spring 21 remain completely housed in the hollow 18 and the sleeve 4 can therefore be easily inserted into the tubular end portion 9 so that the projection 15 penetrates the niche 12 while the slider 28 and the spring 21 are radially locked by the wall 10.

The sleeve 4 is fastened to the tubular end portion 9 by bending the fins 14 and by means of indentations of the same tubular end portion 9.

When the sleeve 4 is completely inserted into the tubular end portion 9, with its bent rim 16 abutting against the rim 19, the slider 28 is positioned below the slot 13. The pushbutton 36 is then fastened to the slider 28 by causing the wings 37 to penetrate through the slot 13 and snap-on couple the inner small teeth 38 to the recesses of the narrow portion 20.

According to a further embodiment, after the sleeve 4 has been mounted over the inner tube, the tubular end portion 9 of the outer tube 3 is partially mounted over the sleeve 4. Then, the inner tube 2 and the outer tube 3 are inserted into respective jaws of an assembling machine (not shown). Afterwards, the small plate 23, the slider 28 and the spring 21 are placed into the hollow 18 of the sleeve 4 and the spring 21 is compressed so that the slider and the spring 21 are fully housed inside the hollow. Then, the jaws of the assembling machine are caused to advance one towards the other so that the inner tube 2 and the sleeve 4 are inserted into the outer tube 3. The sleeve 4 fully penetrates the tubular end portion 9 and is centered in the outer tube 3 thanks to the cooperation of the projection 15 with the niche 12 of the relief 11. Then the sleeve 4 is fastened to the tubular end portion 9 and the pushbutton 36 is fastened to the slider 28 according to the assembling steps described above.

Figure 8:
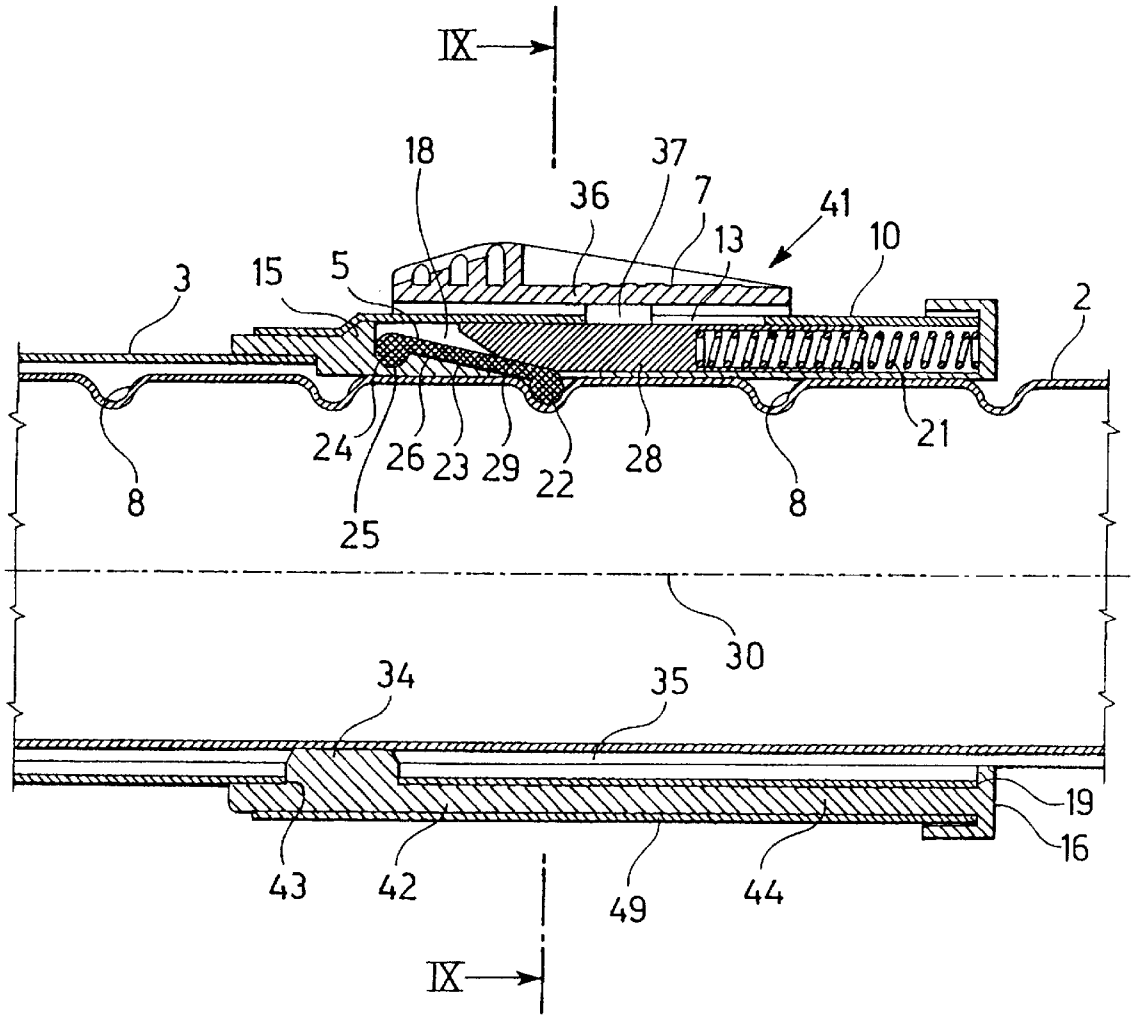
FIG. 8 is a longitudinal cross-sectional view of a variant of the telescopic extension of FIG. 1.

FIGS. 8 and 9 show a variant of the extension of FIG. 1, referred to as 41, in which the same parts are marked with the same reference numerals. In the telescopic extension 41, a tubular end portion 49 is a piece separate from the outer tube 3 and has an internal diameter larger than the outer diameter of the outer tube 3. A sleeve 44 is fitted over the outer tube 3 and interposed between the tube 3 and the tubular end portion 49. The sleeve 44 is fastened to the tube 3 by means of partially elastic tangs engaging corresponding openings in the tube 3, as in the telescopic extension of EP-B1-0 601 620. A partially elastic tang 42 is provided with a protrusion 34 which penetrates an opening 43 in the outer tube 3 and engages a longitudinal groove 35 of the inner tube 2. The tubular portion 49 is fastened to the sleeve 44 by bent fins 14 and indentations (not shown).

Also in the extension 41 the slider 28 is a piece separate from the pushbutton 36 and has a lengthened and flattened shape. The pushbutton 36 is fastened to the slider 28 by means of wings 37 and inner small teeth 38 which penetrate a slot 13 in the tubular end portion 49.

The extension 41 is assembled by a method similar to that described in relation to the extension 1. The sleeve 44 is fitted over the outer tube 3. Afterwards the small plate 23 having integral cylinder 22 and pin 24, slider 28 and spring 21 are mounted completely flush in the hollow 18 of the sleeve 44. The tubular end portion 49 is then fitted over the sleeve 44 and fastened to the sleeve. Finally, the pushbutton 36 is fastened to the slider 28 by causing the wings 37 to penetrate the slot 13 and snap-on couple the inner small teeth 38 into the recesses of the narrow portion 20.

What is claimed is:

1. A telescopic extension for a household appliance comprising:

an inner tube and an outer tube sliding tightly within each other, a sleeve, a constraining member capable of fastening the inner tube and the outer tube, a thrust element in engagement with the constraining member under the action of a spring, an actuator operatively connected to the thrust element, the inner tube being provided with a row of notches of preselected shape, the outer tube having a tubular end portion, the tubular end portion being provided with a slot, the sleeve being fastened to the tubular end portion, the constraining member, thrust element, and the spring being movably supported in the sleeve, the thrust element being biased by the spring to bear on the constraining member to force the constraining member into one of the notches to lock the inner tube in the outer tube, the actuator selectively disengaging the thrust element from the constraining member to let the constraining member exit from the one of the notches and unlock the inner tube from the outer tube, allowing the inner tube to slide with respect to the outer tube for adjusting the length of the extension, the thrust element being formed by a slider, the slot being spaced from an end of the outer tube, the outer tube extending between the thrust element and the actuator the outer tube to at least partially house the thrust element and the spring, the actuator comprising a piece separate from the thrust element, the actuator having protruding wings capable of penetrating the slot, the tubular end portion having a relief forming a niche, the sleeve being provided with a projection which is inserted in the niche, the sleeve having a hollow wherein the constraining member, thrust element, and spring are completely housed, the thrust element being formed by a slider provided with a narrow portion having recesses, the protruding wings of the actuating means being provided with inner small teeth for selective snap-on coupling with the recesses of the slider.

2. A telescopic extension according to claim 1, wherein the slider is further provided with a blind hole which at least partially houses the spring and an inclined wall which selectively engages the constraining member.

3. A telescopic extension according to claim 1, wherein the actuator comprises a pushbutton.

4. A telescopic extension according to claim 1, wherein the constraining member selectively moves in a substantially radial direction within the hollow of the sleeve.

5. A telescopic extension according to claim 1, wherein the sleeve has a bent rim and is positioned longitudinally inside the tubular end portion by means of the bent rim.

6. A telescopic extension according to claim 1, wherein the slot is formed in an upper wall of the relief, and that the slider and spring are completely flush-mounted in the hollow inside the upper wall of the relief.

7. A telescopic extension according to claim 1, wherein the constraining member comprises a small cylinder integral with a small plate and is provided with a pin, wherein the hollow has a ramp on which the small plate rests and a cavity in which the pin is rotatably supported.

8. A telescopic extension according to claim 7, wherein the hollow is provided with an opening which allows the small cylinder to move in a substantially radial direction to engage the notch of the inner tube and to disengage from the notch.

9. A telescopic extension for a household appliance comprising:

an inner tube and an outer tube sliding tightly within each other, a sleeve, a constraining member capable of fastening the inner tube and the outer tube, a thrust element in engagement with the constraining member under the action of a spring, an actuator operatively connected to the thrust element, the inner tube being provided with a row of notches of preselected shape, the outer tube having a tubular end portion, the tubular end portion being provided with a slot, the sleeve being fastened to the tubular end portion, the constraining member, thrust element, and the spring being movably supported in the sleeve, the thrust element being biased by the spring to bear on the constraining member to force the constraining member into one of the notches to lock the inner tube in the outer tube, the actuator selectively disengaging the thrust element from the constraining member to let the constraining member exit from the one of the notches and unlock the inner tube from the outer tube, allowing the inner tube to slide with respect to the outer tube for adjusting the length of the extension, the thrust element being formed by a slider, the actuator comprising a piece separate from the thrust element, the actuator having protruding wings capable of penetrating the slot, the tubular end portion having a relief forming a niche, the sleeve being provided with a projection which is inserted in the niche, the sleeve having a hollow wherein the constraining member, thrust element, and spring are completely housed, the thrust element being formed by a slider provided with a narrow portion having recesses, the protruding wings of the actuating means being provided with inner small teeth for selective snap-on coupling with the recesses of the slider, wherein the tubular end portion is integral with the outer tube and has essentially a same internal diameter and a same outer diameter as the outer tube.

10. A telescopic extension for a household appliance comprising:

an inner tube and an outer tube sliding tightly within each other, a sleeve, a constraining member capable of fastening the inner tube and the outer tube, a thrust element in engagement with the constraining member under the action of a spring, an actuator operatively connected to the thrust element, the inner tube being provided with a row of notches of preselected shape, the outer tube having a tubular end portion, the tubular end portion being provided with a slot, the sleeve being fastened to the tubular end portion, the constraining member, thrust element, and the spring being movably supported in the sleeve, the thrust element being biased by the spring to bear on the constraining member to force the constraining member into one of the notches to lock the inner tube in the outer tube, the actuator selectively disengaging the thrust element from the constraining member to let the constraining member exit from the one of the notches and unlock the inner tube from the outer tube, allowing the inner tube to slide with respect to the outer tube for adjusting the length of the extension, the thrust element being formed by a slider, the actuator comprising a piece separate from the thrust element, the actuator having protruding wings capable of penetrating the slot, the tubular end portion having a relief forming a niche, the sleeve being provided with a projection which is inserted in the niche, the sleeve having a hollow wherein the constraining member, thrust element, and spring are completely housed, the thrust element being formed by a slider provided with a narrow portion having recesses, the protruding wings of the actuating means being provided with inner small teeth for selective snap-on coupling with the recesses of the slider, wherein the slot is equipped with protruding fins which are selectively bent back to lock the sleeve inside the tubular end portion.

11. A telescopic extension for a household appliance comprising:

an inner tube and an outer tube sliding tightly within each other, a sleeve, a constraining member capable of fastening the inner tube and the outer tube, a thrust element in engagement with the constraining member under the action of a spring, an actuator operatively connected to the thrust element, the inner tube being provided with a row of notches of preselected shape, the outer tube having a tubular end portion, the tubular end portion being provided with a slot, the sleeve being fastened to the tubular end portion, the constraining member, thrust element, and the spring being movably supported in the sleeve, the thrust element being biased by the spring to bear on the constraining member to force the constraining member into one of the notches to lock the inner tube in the outer tube, the actuator selectively disengaging the thrust element from the constraining member to let the constraining member exit from the one of the notches and unlock the inner tube from the outer tube, allowing the inner tube to slide with respect to the outer tube for adjusting the length of the extension, the thrust element being formed by a slider, the actuator comprising a piece separate from the thrust element, the actuator having protruding wings capable of penetrating the slot, the tubular end portion having a relief forming a niche, the sleeve being provided with a projection which is inserted in the niche, the sleeve having a hollow wherein the constraining member, thrust element, and spring are completely housed, the thrust element being formed by a slider provided with a narrow portion having recesses, the protruding wings of the actuating means being provided with inner small teeth for selective snap-on coupling with the recesses of the slider, wherein the tubular end portion is a piece separate from the outer tube and has an internal diameter greater than an external diameter of the outer tube, the sleeve being interposed between the outer tube and the separate tubular end portion.

12. A method for assembling a telescopic extension for a household appliance, the telescopic extension comprising an inner tube, an outer tube, a sleeve, a constraining member for securing the inner tube and outer tube, a thrust element, an actuator, and a spring, the inner tube being provided with a row of notches having a preselected shape, the outer tube having a tubular end portion provided with a slot, the slot being spaced from an end of the outer tube, the actuator comprising a piece separate from the thrust element and having protruding wings capable of penetrating the slot, wherein the method comprises the following steps:

a) fitting the sleeve over one of said inner tube and outer tube, b) movably placing the constraining member, thrust element, and spring in the sleeve, c) inserting the inner tube in the outer tube so as to tightly slide one within the other, and inserting the sleeve in the tubular end portion so that the outer tube extends between the thrust element and the actuator the outer tube to at least partially house the thrust element and the spring, d) inserting the wings of the actuator in the slot of the tubular end portion, e) in step b), substantially housing the constraining member, thrust element, and spring into a hollow of a projection of the sleeve, f) in step c), centering the sleeve in respect of the outer tube by fitting the projection into a niche of a relief of the tubular end portion, and g) in step d), snap coupling inner small teeth of the wings to recesses of a slider which forms the thrust element so that the actuator is fastened to the thrust element.

13. A method according to claim 12, further comprising longitudinally positioning the sleeve inside the tubular end portion by means of a bent rim.

14. A method for assembling a telescopic extension for a household appliance, the telescopic extension comprising an inner tube, an outer tube, a sleeve, a constraining member for securing the inner tube and outer tube, a thrust element, an actuator, and a spring, the inner tube being provided with a row of notches having a preselected shape, the outer tube having a tubular end portion provided with a slot, the actuator comprising a piece separate from the thrust element and having protruding wings capable of penetrating the slot, wherein the method comprises the following steps:

a) fitting the sleeve over one of said inner tube and outer tube, b) movably placing the constraining member, thrust element, and spring in the sleeve, c) inserting the inner tube in the outer tube so as to tightly slide one within the other, inserting the sleeve in the tubular end portion, and locking the sleeve in the tubular end portion by bending back protruding fins of the slot, d) inserting the wings of the actuator in the slot of the tubular end portion, e) in step b), substantially housing the constraining member, thrust element, and spring into a hollow of a projection of the sleeve, f) in step c), centering the sleeve in respect of the outer tube by fitting the projection into a niche of a relief of the tubular end portion, and g) in step d), snap coupling inner small teeth of the wings to recesses of a slider which forms the thrust element so that the actuator is fastened to the thrust element.

* * * * *